US007063182B2

(12) United States Patent
Proctor

(10) Patent No.: US 7,063,182 B2
(45) Date of Patent: Jun. 20, 2006

(54) MUFFLER BAFFLE PLATE SPACER FORMED FROM STOCK MATERIAL

(75) Inventor: David F. Proctor, Greenwood, IN (US)

(73) Assignee: ArvinMeritor Technology, LLC, Troy, MI (US)

( * ) Notice: Subject to any disclaimer, the term of this patent is extended or adjusted under 35 U.S.C. 154(b) by 396 days.

(21) Appl. No.: 10/641,911

(22) Filed: Aug. 14, 2003

(65) Prior Publication Data

US 2005/0034919 A1 Feb. 17, 2005

(51) Int. Cl.
*F01N 1/02* (2006.01)
*B21D 51/16* (2006.01)

(52) U.S. Cl. ..... 181/268; 181/269; 181/272; 181/249; 29/890.08

(58) Field of Classification Search ..... 181/268, 181/269, 272, 249
See application file for complete search history.

(56) References Cited

U.S. PATENT DOCUMENTS

| | | | | |
|---|---|---|---|---|
| 3,469,653 | A * | 9/1969 | Vautaw et al. | 181/266 |
| 4,124,092 | A * | 11/1978 | Kajiya et al. | 181/265 |
| 4,456,091 | A | 6/1984 | Blanchot | |
| 4,719,988 | A | 1/1988 | Kinouchi | |
| 4,911,262 | A * | 3/1990 | Tani et al. | 181/266 |
| 4,972,921 | A | 11/1990 | Takada | |
| 5,246,473 | A | 9/1993 | Harris | |
| 5,559,308 | A | 9/1996 | Hayashi | |
| 5,614,699 | A * | 3/1997 | Yashiro et al. | 181/254 |
| 5,708,237 | A * | 1/1998 | Maeda et al. | 181/254 |
| 5,773,770 | A | 6/1998 | Jones | |
| 5,801,343 | A * | 9/1998 | Suzuki et al. | 181/254 |
| 5,801,344 | A * | 9/1998 | Herold | 181/272 |
| 5,984,045 | A * | 11/1999 | Maeda et al. | 181/254 |
| 6,250,422 | B1 | 6/2001 | Goplen | |
| 6,257,367 | B1 | 7/2001 | Allman | |
| 6,341,664 | B1 | 1/2002 | Gerber | |
| 6,457,553 | B1 | 10/2002 | Goplen | |
| 2002/0033303 | A1* | 3/2002 | Nagai et al. | 181/237 |

FOREIGN PATENT DOCUMENTS

| | | | |
|---|---|---|---|
| JP | 55049501 | A * | 4/1980 |
| JP | 60132014 | A * | 7/1985 |
| JP | 61164028 | A * | 7/1986 |
| JP | 02241917 | A * | 9/1990 |
| JP | 06010648 | A * | 1/1994 |

* cited by examiner

*Primary Examiner*—Edgardo San Martin
(74) *Attorney, Agent, or Firm*—Carlson, Gaskey & Olds

(57) ABSTRACT

A muffler has a pair of spaced baffle plates that each receive a flow tube. The flow tubes have spaced ends such that an intermediate chamber is defined to receive air flow to be dampened. In existing mufflers, a bracket needed to be formed to the desired length to support the two spaced baffle plates. The inventive support tube is cut to the desired length, and then utilized to provide the support between the two baffle plates. The support tube is preferably of a diameter that is much smaller than the flow tubes. The support tube may be deformed to have a blockage preventing flow of air through the support tube.

13 Claims, 2 Drawing Sheets

MUFFLER BAFFLE PLATE SPACER FORMED FROM STOCK MATERIAL

BACKGROUND OF THE INVENTION

This invention relates to a spacer for use between baffle plates in a muffler, wherein the spacer is formed of a stock material having a relatively constant cross section such that the spacer can be cut to length.

Mufflers are utilized to dampen the sound on the exhaust of vehicles. The mufflers utilized in modem vehicles consist of a number of tubes, and open spaces which are positioned along a serial flow path. Modern muffler designers utilize both open expanded spaces, and flow tubes to achieve the desired sound dampening effect. An open space is typically defined between a pair of baffle plates. A first tube extends through one baffle plate and has a discharge end opening into the space between the two baffle plates. Another tube is mounted in the opposed baffle plate, to receive air from the space. Often, the two baffle plates will receive another flow tube extending completely through the space. The tube which extends through the space provides support to hold the baffle plates at a design distance. However, as stated above, there are also tubes that do not extend between the baffle plates. Adjacent these spaced tubes, some additional support is desirable to maintain a desired spacing between the baffle plates.

The prior art has utilized a stamped spacer or bracket between the baffle plates to provide the support. While the stamped bracket has provided the function of maintaining a desired distance between the baffle plates, it has required a particular tool manufactured for each new size. Thus, when a muffler designer designs a new muffler having a somewhat different spacing between the baffle plates, a new tool must be prepared to make the bracket. This is undesirably expensive and also hinders the muffler designer from selecting a unique spacing between baffle plates which would be most desirable for a particular muffler design.

SUMMARY OF THE INVENTION

In a disclosed embodiment of this invention, the spacer for maintaining a distance between two spaced baffle plates is formed from a stock material, and most preferably a tubular material that may be cut to the desired length. In preferred embodiments, the spacer tube may be deformed after cutting such that flow is prevented through the spacer tube. In further preferred features of this invention, the tube has a diameter that is less than half the diameter of the flow tubes also positioned within the muffler. More preferably, the spacer tube has a diameter that is less than a third of the diameter of the flow tubes.

These and other features of the present invention can be best understood from the following specification and drawings, the following of which is a brief description.

DETAILED DESCRIPTION OF THE PREFERRED EMBODIMENT

Figure 1:
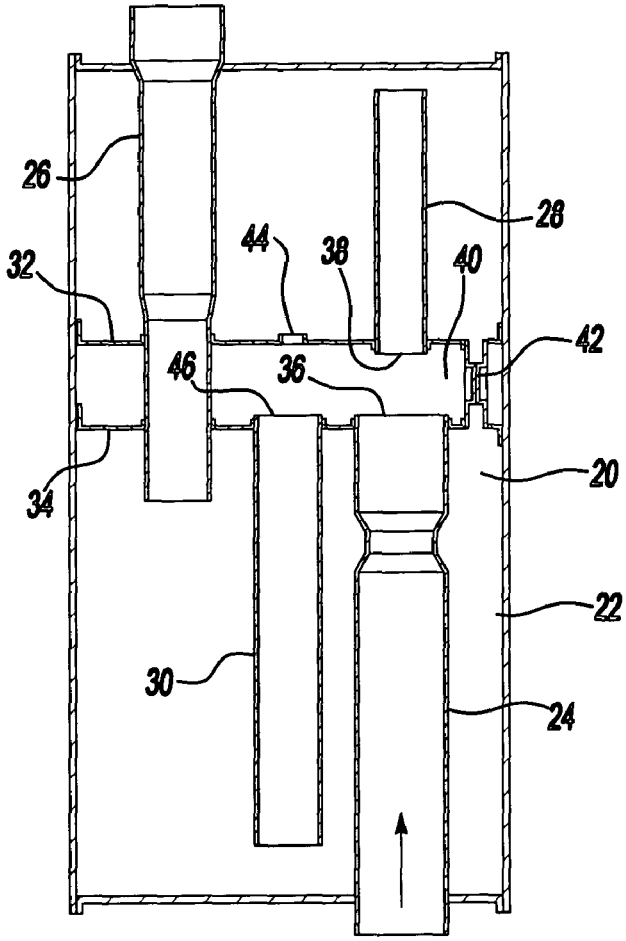
FIG. 1 is a cross-sectional view through a muffler incorporating the present invention.

As shown in FIG. 1, a muffler 20 includes an outer housing 22 receiving an inlet tube 24. Inlet pipe 24 communicates air from a vehicle exhaust to an outlet tube 26. As shown, a tuning throat tube 28 is spaced from the inlet tube 24 and communicates the air to a second tuning throat tube 30. Spaced baffle plates 32 and 34 receive the outlet tube 26. Notably, an outlet end 36 of the inlet tube 24 communicates the air to an inlet end 38 of the tuning throat tube 28. An intermediate open spacer or chamber 40 is formed between the outlet end 36 of the inlet tube 24 and the inlet end 38 of the tuning throat tube 28. Chamber 40 provides a sound dampening function, as known to a worker of ordinary skill in this art. In the prior art, to maintain the spacing between the baffle plates 32 and 34 in the vicinity of the inlet tube 36 and tuning throat tube 38, a bracket needed to be sized to the particular distance between the baffle plates 32 and 34. The present invention uses a spacer tube 42 cut to a desired length to provide this support.

A perforation 44 in the baffle plate 32 receives air from the tuning throat tube 28 and returns this air to an inlet end 46 of the tuning throat tube 30. From the outlet end of the tuning throat tube 30, the air enters the inlet end of the outlet tube 26, and then leaves the muffler.

Figure 2A:
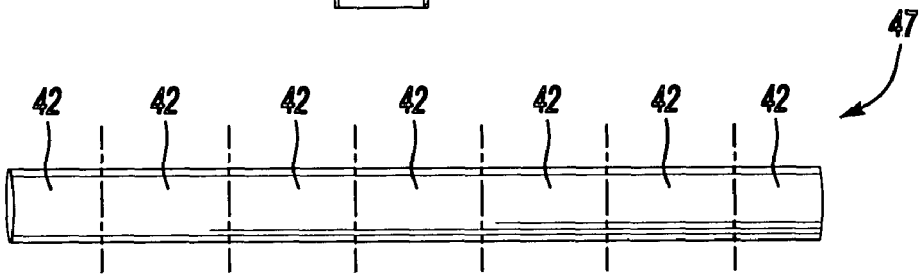
FIG. 2A is a first step in forming the spacer tube of the present invention.

The present invention improves upon the prior art by utilizing tube stock such as shown at 47 in FIG. 2A to form spacers 42. As shown, a plurality of spacer tubes 42 may be cut from a single piece of tube stock 47. Now, when the muffler designer reaches a decision as to a desired distance between the baffle plates 32 and 34, he need not make a tool to form a bracket of that desired distance. Rather, the tube stock 47 is merely cut to the necessary length.

Figure 2B:
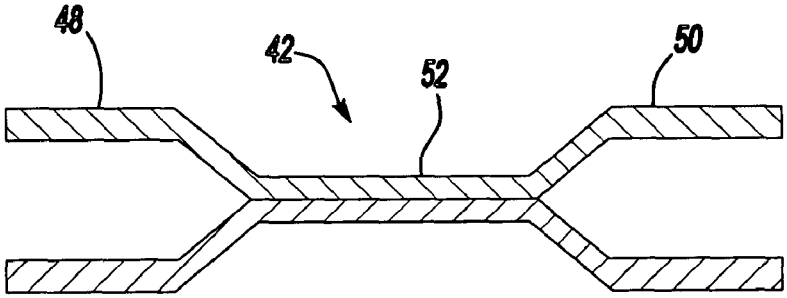
FIG. 2B shows a final spacer tube.

As shown in FIG. 2B, it is desirable that the spacer tube 42 have its ends 48 and 50 maintain the desired the original cross-sectional shape, while an intermediate blocked portion 52 is crimped or otherwise deformed to block flow between the ends 48 and 50. In a preferred embodiment, the spacer tube 42 may simply be crimped in three or more spaced portions to block flow. Now, when the spacer tube 42 is positioned between the baffle plates 32 and 34, it will have no effect on the noise dampening from the muffler 20, as air will not flow through the tube 42 due to the blockage 52.

Figure 3:
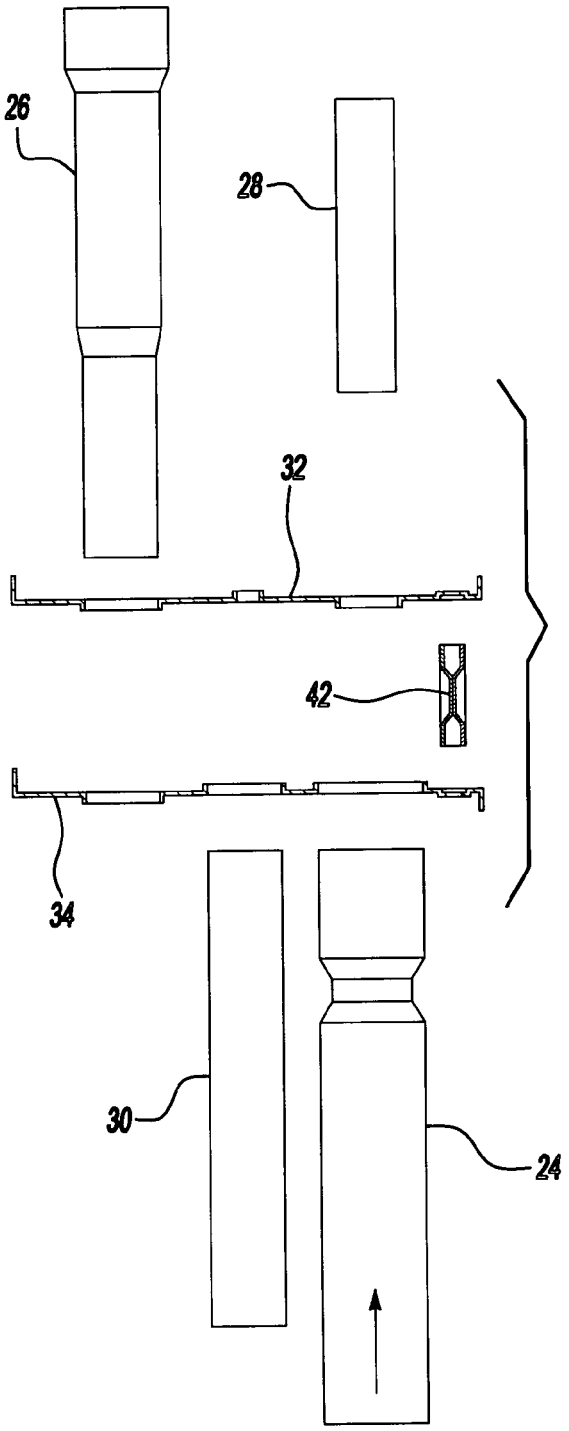
FIG. 3 shows the assembly of a muffler incorporating the inventive spacer.
Figure 4:
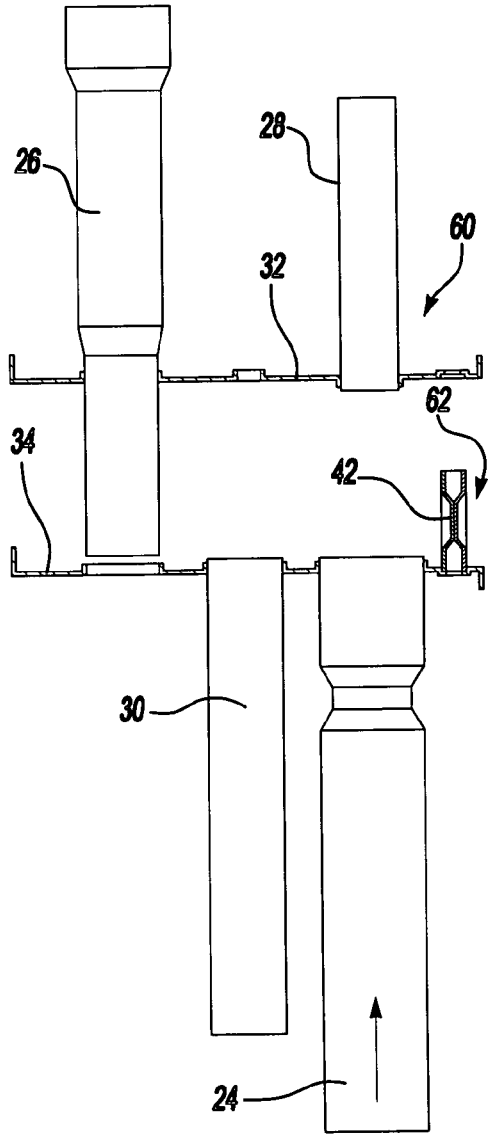
FIG. 4 shows a step subsequent to the FIG. 3 step in assembling the inventive muffler.

To form the muffler of the present invention, initially the baffle plates 32 and 34 receive the tubes 24, 26, 28, 30 and 42 as shown schematically in FIG. 3. As shown in FIG. 4, a first sub-assembly 60 including the baffle plate 32, the tuning throat tube 28, the outlet tube 26 is formed. A second sub-assembly 62 including baffle plate 34, tuning throat tube 30, and an inlet pipe 24 is also formed. Further, the spacer tube 42 is associated with baffle plate 34, although, of course, it could be initially associated with baffle plate 32. The spacer tube 42 is connected to each of the baffle plates 32 and 34 by a flare-lock connection, which is essentially formed by forcing a frusto-conical member into an end of the tube to bend the outermost lip of the tube 42 radially outwardly and lock it to the baffle plates 32 and 34, respectively.

The spacer tube 42 provides a spacer and support function at the end of the chamber 40 adjacent to where the tube outlet end 36 is spaced from the tuning throat inlet end 38. That is, where there is no other mechanical support, the spacer tube 42 provides support. While the spacer tube 42 is preferably cylindrical, other tube cross sections such as rectangular can be utilized.

In preferred embodiments, the inlet and outlet tubes 24 and 26 may be between 2" and 3" while the tuning throat tubes 28 and 30 may be more on the order of 1.5". In such a diameter muffler, the spacer tube 42 would be on the order of 0.5".

While a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A muffler comprising:

an inlet tube for communicating an air flow to be muffled into a housing and an outlet tube for receiving said air flow and moving said air flow outwardly of said housing;

a pair of spaced baffle plates within said housing, said pair of spaced baffle plates defining an intermediate chamber, a first tube having an outlet end communicating air into said intermediate chamber, and a second tube having an inlet end communicating with a downstream end of said intermediate chamber to receive said air flow and pass air further downstream, with said outlet end of said first tube and said inlet end of said second tube being spaced across said intermediate chamber; and a support tube positioned between said pair of spaced baffle plates adjacent to said first and said second tubes, such that said support tube provides support and spacing between said pair of spaced baffle plates, said support tube having a blockage along an axial length, such that air flow is blocked outwardly from, said intermediate chamber and through said support tube.

2. A muffler as set forth in claim 1, wherein said support tube has a cylindrical cross-sectional shape.

3. A muffler as set forth in claim 1, wherein said blockage is between said pair of spaced baffle plates.

4. A muffler comprising:

an inlet tube for communicating an air flow to be muffled into a housing and an outlet tube for receiving said air flow and moving said air flow outwardly of said housing;

a pair of spaced baffle plates within said housing, said pair of spaced baffle plates defining an intermediate chamber, a first tube having an outlet end communicating air into said intermediate chamber, and a second tube having an inlet end communicating with a downstream end of said intermediate chamber to receive said air flow and pass air further downstream, with said outlet end of said first tube and said inlet end of said second tube being spaced across said intermediate chamber; and a support tube positioned between said pair of spaced baffle plates adjacent to said first and second tubes, such that said support tube provides support and spacing between said pair of spaced baffle plates;

said first and said second tubes having diameters that are at least twice the diameter of said support tube.

5. A muffler as set forth in claim 1, wherein said first tube is also said inlet tube.

6. A muffler as set forth in claim 1, wherein said outlet end of said first tube and said inlet end of said second tube are coaxially mounted within said pair of spaced baffle plates.

7. A muffler comprising:

an inlet tube for passing an air flow into a muffler housing, said muffler housing further receiving first and second spaced baffle plates, with a chamber being defined between said first and second spaced baffle plates, said inlet tube mounted in said first baffle plate, said inlet tube having an outlet end for communicating air into said chamber;

a tuning throat tube mounted in said second baffle plate, said tuning throat tube receiving air from said chamber and communicating air further downstream towards an outlet tube, said outlet tube extending through both of said first and second spaced baffle plates; and a support tube fixed between said first and second spaced baffle plates in the vicinity of said inlet tube and said tuning throat tube, said support tube being formed from a material having a generally constant cross-sectional between a first and second end, said support tube not extending beyond said first and second spaced baffle plates, and said support tube having a blockage at an intermediate position between said first and second spaced baffle plates.

8. A muffler as set forth in claim 7, wherein said support tube has ends that are flare-locked to said first and second spaced baffle plates.

9. A muffler as set forth in claim 7, wherein said material for said support tube has a cylindrical cross-sectional shape.

10. A muffler as set forth in claim 9, wherein said blockage prevents air from flowing through said support tube.

11. A muffler as set forth in claim 7, wherein said inlet and outlet tubes have diameters that are at least twice the diameter of said support tube.

12. A method or forming a muffler comprising the steps of:

(1) determining a distance between first and second spaced baffle plates, and cutting a number of support tubes from a piece of tubing stock to a desired length corresponding to the distance between said first and second spaced baffle plates;

(2) securing one of said number or support tubes to each of said first and second spaced baffle plates adjacent to a pair of spaced flow tubes such that said support tube provides support between said first and second spaced baffle plates; and (3) deforming said support tube to form a blockage along a length of said support tube to limit air from flowing within said support tube, into and out of a chamber defined between said first and second spaced baffle plates.

13. The method of claim 12, wherein said blockage is formed at a location between said first and second spaced baffle plates.

* * * * *